US006133214A

United States Patent [19]

Jung et al.

[11] Patent Number: 6,133,214

[45] Date of Patent: Oct. 17, 2000

[54] PORTIONED DETERGENT COMPOSITION

[75] Inventors: Dieter Jung, Hilden; Bernd Larson, Erkelenz; Wilfried Raehse, Duesseldorf; Peter Sandkuehler, Erkelenz; Hans-Peter Siegers, Wegberg; Hermann-Josef Welling, Düsseldorf, all of Germany

[73] Assignee: Henkel Kommanditgesellschaft auf Aktien, Duesseldorf, Germany

[21] Appl. No.: 09/353,666

[22] Filed: Jul. 15, 1999

[30] Foreign Application Priority Data

Jul. 15, 1998 [DE] Germany ..... 198 31 703

[51] Int. Cl.[7] ..... C11D 17/06; C11D 17/04; C11D 11/00

[52] U.S. Cl. ..... 510/296; 510/360; 510/439; 510/444; 510/473; 510/474; 510/475

[58] Field of Search ..... 510/296, 439, 510/360, 444, 473, 474, 475

[56] References Cited

U.S. PATENT DOCUMENTS

| | | | |
|---|---|---|---|
| 3,234,258 | 2/1966 | Morris | 289/351 |
| 3,374,195 | 3/1968 | Bianco et al. | 260/29.6 |
| 4,234,442 | 11/1980 | Cornelissens | 510/277 |
| 4,664,839 | 5/1987 | Rieck | 252/175 |
| 4,806,261 | 2/1989 | Ciallella et al. | 510/296 |
| 5,019,609 | 5/1991 | Toyonishi et al. | 524/35 |
| 5,075,041 | 12/1991 | Lutz | 252/548 |
| 5,234,615 | 8/1993 | Gladfelter et al. | 510/439 |
| 5,356,607 | 10/1994 | Just | 423/334 |
| 5,417,951 | 5/1995 | Just | 423/334 |
| 5,780,418 | 7/1998 | Niinaka et al. | 510/439 |
| 5,780,420 | 7/1998 | Breuer et al. | 510/466 |
| 5,863,885 | 1/1999 | Ruggieri et al. | 510/439 |

FOREIGN PATENT DOCUMENTS

| | | |
|---|---|---|
| 0 143 476 | 6/1985 | European Pat. Off. . |
| 0 158 464 | 10/1985 | European Pat. Off. . |
| 0 385 529 | 9/1990 | European Pat. Off. . |
| 11 30 547 | 5/1962 | Germany . |
| 38 16 842 | 11/1989 | Germany . |
| 44 00 024 | 7/1995 | Germany . |
| 58 217598 | 12/1983 | Japan . |
| 05214398 | 8/1993 | Japan . |
| 0 164 514 | 12/1985 | WIPO . |
| WO90/13533 | 11/1990 | WIPO . |
| WO91/08171 | 6/1991 | WIPO . |
| WO95/07331 | 3/1995 | WIPO . |

*Primary Examiner*—Lorna M. Douyon
*Attorney, Agent, or Firm*—Wayne C. Jaeschke; Glenn E. J. Murphy

[57] ABSTRACT

A portioned detergent composition in a bag of water-soluble film in which at least 70% by weight of the particles of the detergent composition have particle sizes above 800 $\mu$m. The choice of this particular particle size range eliminates otherwise typical production-related problems arising out of the permeability of the bag seams and resulting difficulties.

19 Claims, No Drawings

PORTIONED DETERGENT COMPOSITION

This invention relates to portioned detergent compositions which make detergents easier to dose by the consumer. More particularly, the invention relates to portioned detergent compositions which are packed in a bag of water-soluble film and which are referred to in short as "portion bags".

Detergents and processes for their production have been known for some considerable time and, accordingly, are widely described in the prior art literature. They are normally marketed in the form of spray-dried or granulated powders or as liquids. In response to consumer demand for easy dosing, products in pre-portioned form have established themselves on the market alongside these two conventional variants and have also been comprehensively described in the prior art literature, press-agglomerated elements, i.e. tablets, blocks, briquettes and the like, and portions of solid or liquid detergents packed in bags being described in particular.

In the case of individual doses of detergents which are packed in bags for marketing, bags of water-soluble film, i.e. bags which do not have to be torn open by the user, have proved successful. In this way, an individual portion can be conveniently dosed by directly placing the bag in the dispensing compartment of the washing machine or dishwashing machine or by throwing the bag into a predetermined quantity of water, for example in a bucket or in a hand-washing or rinsing bowl. Accordingly, detergents packed in bags of water-soluble film have been widely described in the prior art literature.

Thus, DE-AS 11 30 547 (Procter & Gamble) discloses packs of water-soluble films of polyvinyl alcohol which are filled with non-liquid synthetic detergents. The particle sizes of the packed detergents are not mentioned in this document.

An individual dose of a detergent or bleach in a bag comprising one or more seams of water-sensitive material is described in European patent application EP 143 476 (Akzo N.V.). A mixture of anionic and/or nonionic water-binding polymer and cationic polymer adhesive is proposed as the water-sensitive seam material in this document. It is pointed out in the specification that the bags according to the invention can be effective containers for pellets and extrudates, although no reference is made to the particle sizes of the packed detergent or bleach.

European patent application EP 158 464 (Clorox) describes low-temperature detergents which can be packed in a bag of water-soluble film. This document only contains particle size data for the builder component (sodium tripolyphosphate) of the packed detergents, the particle sizes being between 75 and 400 μm.

Extremely large particles wrapped in a water-insoluble film are described in EP 384 529 (Procter & Gamble). This document discloses a "jumbo"-particle fabric softener composition of which the 5 to 30 mm large dryer-activated particles are wrapped in a porous water-insoluble film.

It has been found that known detergent compositions packed in portion bags are attended by production-related problems. When the detergent compositions are packed in the water-soluble film, fine particles adhere to the film and, in the sealing of the film to form the closed bag, enter the seams forming the bag. Through the presence of these particles in the seal, the seams in question are not totally impervious to the atmosphere which can lead to stability problems affecting the detergent composition. In addition, in the case of hygroscopic ingredients, the detergent composition is in danger of absorbing moisture from the surrounding air and forming lumps despite the presence of the bag. In serious cases, the detergent composition becomes so moist that it softens the bag film and affects its stability to such an extent that the consumer is no longer able to remove an individual dose, but instead finds a softened product/film conglomerate in the bag.

In the case of temperature-sensitive ingredients, it can additionally happen that particles trapped in the seam to be formed are thermally stressed where a heat sealing process is used which can lead to further leaks, discoloration or, in the worst case, even to accidents through thermal decomposition of the particles.

The problem addressed by the present invention was to avoid these problems and to provide a portioned detergent composition in which the seams of the bag consisting of water-soluble film would be impervious to the atmosphere. It has now been found that the above-mentioned problems of impervious seams and the resulting difficulties can be avoided if the detergent compositions to be portioned satisfy certain criteria in regard to their particle size.

Accordingly, the present invention relates to a portioned detergent composition in a bag of water-soluble film, characterized in that at least 70% by weight of the particles of the detergent composition have particle sizes above 800 μm.

In the particle size range in question, the above-mentioned problems caused by trapping of particles adhering to the film in the seams no longer occur. The at least 70% by weight of the particles and the 800 μm are meant to be taken as lower limits which result, for example, from the fact that "powdering" of the detergent composition, which introduces a certain percentage of fine particles into the detergent, is desirable for technical reasons. In addition, during production and further processing, the percentage of relatively coarse particles can be reduced by abrasion to form fine particles, even after unwanted fine particles have been removed by sieving. In a preferred embodiment of the invention, however, a high percentage of coarse particles, i.e. well above 70% by weight, is present in the detergent composition. In preferred portioned detergent compositions, at least 80% by weight, preferably at least 85% by weight, more preferably at least 90% by weight and most preferably at least 95% by weight of the particles of the detergent composition have particle sizes above 800 μm, preferably above 900 μm, more preferably above 1,000 μm and most preferably above 1,200 μm.

Another advantage of the present invention is that any fine particles present or formed remain inside the tightly sealed bag and hence within a portion of the detergent. With normal packs, separation occurs during transportation because the fine particles sink to the bottom of the pile of coarse particles.

The portioned detergent compositions according to the invention are packed in bags of water-soluble film. Bag materials or rather films such as these are known from the prior art and emanate for example from the group of (acetalized) polyvinyl alcohol, polyvinyl pyrrolidone, polyethylene oxide, gelatin and mixtures thereof.

Polyvinyl alcohols, referred to in short as PVALs, are polymers with the following general structure:

$$[—CH_2—CH(OH)—]_n$$

which also contain small amounts of structural units of the following type:

$$[—CH_2—CH(OH)—CH(OH)—CH_2]$$

Since the corresponding monomer, vinyl alcohol, is not stable in free form, polyvinyl alcohols are produced via polymer-analog reactions by hydrolysis and—on an industrial scale—above all by alkali-catalyzed transesterification of polyvinyl acetates with alcohols (preferably methanol) in solution. PVALs containing a predetermined residual percentage of acetate groups can also be obtained by these industrial processes.

Commercially available PVALs (for example Mowiol® types, products of Hoechst) are marketed as white-yellowish powders or granules with degrees of polymerization of ca. 500 to 2,500 (corresponding to molecular weights of ca. 20,000 to 100,000 g/mole) and have different degrees of hydrolysis of 98–99 or 87–89 mole-%. Accordingly, they are partly saponified polyvinyl acetates with a residual content of acetyl groups of ca. 1–2 or 11–13 mole-%.

The solubility of PVAL in water can be reduced and thus selectively adjusted to required values by aftertreatment with aldehydes (acetalization), by complexing with Ni or Cu salts or by treatment with dichromates, boric acid, borax. Films of PVAL are largely impervious to gases, such as oxygen, nitrogen, helium, hydrogen, carbon dioxide, but are permeable to water vapor.

Polyvinyl pyrrolidones, referred to in short as PVPs, correspond to the following general formula:

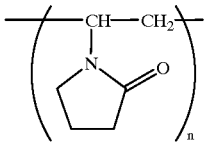

PVPs are produced by radical polymerization of 1-vinyl pyrrolidone. Commercially available PVPs have molecular weights of ca. 2,500 to 750,000 g/mole and are commercially available as white hygroscopic powders or as aqueous solutions.

Polyethylene oxides, referred to in short as PEOXs, are polyalkylene glycols corresponding to the following general formula:

$$H—[O—CH_2—CH_2]_n—OH$$

which are produced on an industrial scale by base-catalyzed polyaddition of ethylene oxide (oxirane) with ethylene glycol as starter molecule in systems generally containing small quantities of water. They have molecular weights in the range from ca. 200 to 5,000,000 g/mole, corresponding to degrees of polymerization n of ca. 5 to >100,000. Polyethylene oxides have an extremely low concentration of reactive terminal hydroxy groups and possess only weak glycol properties.

Gelatin is a polypeptide (molecular weight ca. 15,000–>250,000 g/mole) which is mainly obtained by hydrolysis of the collagen present in the skin and bones of animals under acidic or alkaline conditions. The amino acid composition of gelatin largely corresponds to that of the collagen from which it was obtained and varies according to its provenance. The use of gelatin as a water-soluble capsule material is particularly widespread in pharmacy (hard or soft gelatin capsules). Gelatin is rarely used in the form of films on account of its high price compared with the polymers mentioned above.

Other preferred portioned detergent compositions according to the present invention are those of which the bag consists of water-soluble film of at least one polymer from the group of starch and starch derivatives, cellulose and cellulose derivatives, more especially methyl cellulose and mixtures thereof.

Starch is a homoglycan in which the glucose units are attached by α-glycoside bonds. Starch is made up of two components of different molecular weight, namely ca. 20–30% straight-chain amylose (molecular weight ca. 50,000 to 150,000) and 70–80% of branched-chain amylopectin (molecular weight ca. 300,000 to 2,000,000). Small quantities of lipids, phosphoric acid and cations are also present. Whereas the amylose—on account of the bond in the 1,4-position—forms long, helical entwisted chains containing about 300 to 1,200 glucose molecules, the amylopectin chain branches through a 1,6-bond after—on average—25 glucose units to form a branch-like structure containing about 1,500 to 12,000 glucose molecules. Besides pure starch, starch derivatives obtainable from starch by polymer-analog reactions may also be used in accordance with the invention for the production of water-soluble bags. Such chemically modified starches include, for example, products of esterification or etherification reactions in which hydroxy hydrogen atoms were substituted. However, starches in which the hydroxy groups have been replaced by functional groups that are not attached by an oxygen atom may also be used as starch derivatives. The group of starch derivatives includes, for example, alkali metal starches, carboxymethyl starch (CMS), starch esters and ethers and amino starches.

Pure cellulose has the formal empirical composition $(C_6H_{10}O_5)_n$ and, in formal terms, is a β-1,4-polyacetal of cellobiose which, in turn, is made up of two molecules of glucose. Suitable celluloses consist of ca. 500 to 5,000 glucose units and, accordingly, have average molecular weights of 50,000 to 500,000. Other cellulose-based disintegrating agents which may be used in accordance with the present invention are cellulose derivatives obtainable from cellulose by polymer-analog reactions. Such chemically modified celluloses include, for example, products of esterification or etherification reactions in which hydroxy hydrogen atoms were substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and also aminocelluloses.

Preferred bags of water-soluble film consist of a polymer with a molecular weight in the range from 5,000 to 500,000 dalton, preferably in the range from 7,500 to 250,000 dalton and more preferably in the range from 10,000 to 100,000 dalton. The water-soluble film which forms the bag has a thickness of 1 to 150 μm, preferably 2 to 100 μm, more preferably 5 to 75 μm and most preferably 10 to 50 μm.

The detergent composition packed in the form of an individual dose in the bags of water-soluble film is preferably produced in the required particle size by granulation. In the context of the present invention, the expression "granulation" encompasses any shaping or forming process which leads to particles of predetermined size. Besides conventional granulation and agglomeration processes, which may be carried out in various mixer-granulators and mixer-agglomerators, press agglomeration processes, for example, may also be used.

The granulation process may be carried out in a number of machines typically used in the detergent industry. For example, the rotary pan granulators widely used in the pharmaceutical industry may be employed. In granulators such as these, the residence time of the granules is normally less than 5 minutes. Conventional mixers and mixer-granulators are also suitable for granulation. The mixers used may be both high-shear mixers and also normal mixers with lower rotational speeds and, more particularly, combinations of both. Suitable mixers are, for example, Series R or RV Eirich® mixers (trademarks of Machinenfabrik Gustav Eirich, Hardheim), the Schugi® Flexomix mixer, the Fukae® FS-G mixers (trademarks of Fukae Powtech, Kogyo Co., Japan), Lödige® FM, KM and CB mixers (trademarks of Lödige Maschinenbau GmbH, Paderborn) and Series T or K-T Drais® mixers (trademarks of Drais-Werke GmbH, Mannheim). The residence times of the granules in the mixer combination is less than 60 seconds in the high-speed mixer and less than 7 minutes in the low-speed mixer, the residence time also depending on the rotational speed of the mixer. The residence times are shorter, the higher the rotational speed of the mixer.

In the press agglomeration process, the detergent composition is shear-compacted under pressure in the plastic solidification range of the coating and, at the same time, homogenized and is then discharged from the apparatus via a shaping/forming stage. Industrially the most important press agglomeration processes are extrusion, roll compacting, pelleting and tabletting. Press agglomeration processes preferably used in accordance with the invention for producing the detergent compositions are extrusion, roll compacting and pelleting.

In a preferred embodiment of the invention, the detergent composition is preferably delivered continuously to a planetary roll extruder or to a twin-screw extruder with co-rotating or contra-rotating screws, of which the barrel and the extruder/granulation head may be heated to the predetermined extrusion temperature. Under the shearing effect of the extruder screws, the compound is compacted under pressure (preferably at least 10 bar or—with extremely high throughputs—even lower, depending on the machine used), plasticized, extruded in the form of fine strands through the multiple-bore die in the extruder head and, finally, chopped by means of a rotating blade into preferably substantially spherical or cylindrical granules. The bore diameter of the multiple-bore extrusion die and the length to which the extruded strands are cut are adapted to the size selected for the granules. In this embodiment, it is possible to produce granules with a substantially uniform predetermined particle size, the absolute particle sizes being adaptable to the particular application envisaged. Important embodiments comprise the production of uniform granules in the millimeter range, for example in the range from 0.8 to 5 mm and, more particularly, in the range from about 1.0 to 3 mm. In one important embodiment, the length-to-diameter ratio of the primary granules formed by cutting the extruded strands is between about 0.7:1 and about 3:1. In another preferred embodiment, the still plastic primary granules are subjected to another shaping or forming step in which the edges present on the crude extrudate are rounded off so that spherical or substantially spherical granules can ultimately be obtained. Alternatively, extrusion/press-molding can also be carried out in low-pressure extruders, in a Kahl press, in a Bextruder or in a Plastagglomerator (manufacturer: Pallman).

In another preferred embodiment of the present invention, the detergent composition is produced by roll compacting. In this process, the detergent composition is introduced between two rollers—either smooth or provided with depressions of defined shape—in the plastic solidification range of the coating and rolled under pressure between the two rollers to form a sheet-like compactate. The rollers exert a high linear pressure on the compound and may be additionally heated or cooled as required. Where smooth rollers are used, smooth untextured compactate sheets are obtained. By contrast, where textured rollers are used, correspondingly textured compactates or individual pellets, in which for example certain shapes can be imposed in advance on the subsequent granules, can be produced. The sheet-like compactate is then broken up into smaller pieces by a chopping and size-reducing process and can thus be processed to granules which can be further refined and, more particularly, converted into a substantially spherical shape by further surface treatment processes known per se.

In another preferred embodiment of the present invention, the detergent composition to be packed is produced by pelleting. In this process, the detergent composition is applied to a perforated surface in the plastic solidification range of the coating and is forced through the perforations by a pressure roller. In conventional pellet presses, the detergent composition is compacted under pressure, plasticized, forced through a perforated surface in the form of fine strands by means of a rotating roller and, finally, is size-reduced to granules by a cutting unit. The pressure roller and the perforated die may assume many different forms. For example, flat perforated plates are used, as are concave or convex ring dies through which the material is pressed by one or more pressure rollers. In perforated-plate presses, the pressure rollers may also be conical in shape. In ring die presses, the dies and pressure rollers may rotate in the same direction or in opposite directions. A press suitable for carrying out the process according to the invention is described, for example, in DE-OS 38 16 842 (Schlüter GmbH). The ring die press disclosed in this document consists of a rotating ring die permeated by pressure bores and at least one pressure roller operatively connected to the inner surface thereof which presses the material delivered to the die space through the pressure bores into a discharge unit. The ring die and pressure roller are designed to be driven in the same direction which reduces the shear load applied to the compound and hence the increase in temperature which it undergoes. However, the pelleting process may of course also be carried out with heatable or coolable rollers to enable the compound to be adjusted to a required temperature.

Another press agglomeration process which may be used to produce the detergent composition is tabletting. In this process, the detergent composition is press-molded in a die, coated solid particles being obtainable in various shapes through the design of the top and bottom punches of the tablet press.

Preferred portioned detergent compositions are produced by a granulation or press agglomeration process, more particularly by extrusion.

The portioned detergent compositions according to the invention contain one or more ingredients from the group of surfactants, surfactant compounds, builders, bleaching agents, bleach activators, enzymes, foam inhibitors, dyes and fragrances and also binders and disintegration aids. These classes of ingredients are described in the following.

In order to develop their washing effect, the portioned detergent compositions according to the invention contain surfactants from the group of anionic, nonionic, zwitterionic or cationic surfactants, anionic surfactants being greatly preferred both for economic reasons and by virtue of their performance spectrum.

Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates, $C_{12-15}$ alkyl sulfates and $C_{14-15}$ alkyl sulfates are preferred from the point of view of washing technology. Other suitable anionic surfactants are 2,3-alkyl sulfates which may be produced, for example, in accordance with U.S. Pat. No. 3,234,258 or U.S. Pat. No. 5,075,041 and which are commerially obtainable as products of the Shell Oil Company under the name of DAN®.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

Other preferred anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which, considered in isolation, represent nonionic surfactants (for a description, see below). Of these sulfosuccinates, those of which the fatty alcohol residues are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

According to the invention, preferred portioned detergent compositions are those which contain 5 to 50% by weight, preferably 7.5 to 40% by weight and more preferably 15 to 25% by weight of anionic surfactant(s), based on the detergent composition.

So far as the choice of anionic surfactants used in the portioned detergent compositions according to the invention is concerned, there are no basic requirements to restrict the freedom of formulation. However, preferred portioned detergent compositions do have a soap content in excess of 0.2% by weight, based on the total weight of the detergent composition. Preferred anionic surfactants are alkyl benzenesulfonates and fatty alcohol sulfates, preferred detergent compositions containing 2 to 20% by weight, preferably 2.5 to 15% by weight and more preferably 5 to 10% by weight of fatty alcohol sulfate(s), based on the weight of the detergent composition.

Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil, palm oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially the fatty acid methyl esters which are described, for example, in Japanese patent application JP 58/217598 or which are preferably produced by the process described in International patent application WO-A-90/13533.

Another class of nonionic surfactants which may advantageously be used are the alkyl polyglycosides (APGs). Suitable alkyl polyglycosides correspond to the general formula $RO(G)_z$ where R is a linear or branched, more particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of glycosidation is between 1.0 and 4.0, preferably between 1.0 and 2.0 and more preferably between 1.1 and 1.4.

Linear alkyl polyglucosides, i.e. alkyl polyglycosides in which the polyglycosyl component is a glucose unit and the alkyl component is an n-alkyl group, are preferably used.

The detergent compositions according to the invention may advantageously contain alkyl polyglycosides, APG contents in the detergent compositions of more than 0.2% by weight, based on the press-agglomerated detergent as a whole, being preferred. Particularly preferred detergent compositions contain APGs in quantities of 0.2 to 10% by weight, preferably in quantities of 0.2 to 5% by weight and more preferably in quantities of 0.5 to 3% by weight.

Nonionic surfactants of the amine oxide type, for example N-cocoalkyl-N,N-dimethylamine oxide and N-tallowalkyl-N,N-dihydroxyethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (I):

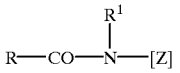

(I)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

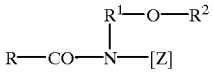

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

Besides the washing-active ingredients, builders are the most important ingredients of detergents. Any of the builders normally used in detergents may be present in the detergent compositions according to the invention, including in particular zeolites, silicates, carbonates, organic co-builders and also—providing there are no ecological objections to their use—phosphates.

Suitable crystalline layer-form sodium silicates correspond to the general formula $Na_2MSi_xO_{2x+1}\cdot y\,H_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates $Na_2Si_2O_5\cdot y\,H_2O$ are particularly preferred, β-sodium disilicate being obtainable, for example, by the process described in International patent application WO-A-91/08171.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The finely crystalline, synthetic zeolite containing combined water used in accordance with the invention is preferably zeolite A and/or zeolite P. Zeolite MAP® (Crosfield) is a particularly preferred P-type zeolite. However, zeolite X and mixtures of A, X and/or P are also suitable. According to the invention, it is also possible to use, for example, a commercially obtainable co-crystallizate of zeolite X and zeolite A (ca. 80% by weight zeolite X) which is marketed by CONDEA Augusta S.p.A. under the name of VEGOGOND AX® and which may be described by the following formula:

$$n\mathrm{Na_2O}.(1-n)\mathrm{K_2O}.\mathrm{Al_2O_3}.(2-2.5)\mathrm{SiO_2}.(3.5-5.5)\mathrm{H_2O}$$

Suitable zeolites have a mean particle size of less than 10 μm (volume distribution, as measured by the Coulter Counter Method) and contain preferably 18 to 22% by weight and more preferably 20 to 22% by weight of combined water.

The generally known phosphates may of course also be used as builders providing their use should not be avoided on ecological grounds. The sodium salts of the orthophosphates, the pyrophosphates and, in particular, the tripolyphosphates are particularly suitable.

Useful organic builders are, for example, the polycarboxylic acids usable, for example, in the form of their sodium salts, such as citric acid, adipic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

In addition to the ingredients—surfactants and builders—mentioned above, the detergents according to the invention may contain other typical detergent ingredients, for example from the group of bleaching agents, bleach activators, enzymes, fragrances, perfume carriers, fluorescing agents, dyes, foam inhibitors, silicone oils, redeposition inhibitors, optical brighteners, discoloration inhibitors, dye transfer inhibitors and corrosion inhibitors.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. If detergent or bleaching compositions for dishwashing machines are being produced, bleaching agents from the group of organic bleaches may also be used. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaoiminoperoxyhexanoic acid (PAP)], o-carboxybenzamidoperoxycaproic acid, N-nonenylamidoperadipic acid and N-nonenylamidopersuccinates. and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents in compositions for dishwashing machines are chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

In order to obtain an improved bleaching effect where washing is carried out at temperatures of 60° C. or lower, bleach activators may be incorporated in the detergents according to the invention. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the detergents according to the invention. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Suitable enzymes are those from the class of proteases, lipases, amylases, cellulases or mixtures thereof. Enzymes obtained from bacterial strains or fungi, such as *Bacillus subtilis, Bacillus licheniformis* and *Streptomyces griseus*, are particularly suitable. Proteases of the subtilisin type are preferred, proteases obtained from *Bacillus lentus* being particularly preferred. Enzyme mixtures, for example of protease and amylase or protease and lipase or protease and cellulase or of cellulase and lipase or of protease, amylase and lipase or of protease, lipase and cellulase, but especially cellulase-containing mixtures, are of particular interest. Peroxidases or oxidases have also proved to be suitable in some cases. The enzymes may be adsorbed to supports and/or encapsulated in shell-forming substances to protect them against premature decomposition. The percentage content of the enzymes, enzyme mixtures or enzyme granules in the detergents according to the invention may be, for example, from about 0.1 to 10% by weight and is preferably from 0.5 to about 5% by weight.

In addition, the detergents according to the invention may also contain components with a positive effect on the removability of oil and fats from textiles by washing (so-called soil repellents). This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

The detergent compositions may contain derivatives of diamino-stilbenzenedisulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

Dyes and fragrances are added to the detergents according to the invention to improve the aesthetic impression created by the products and to provide the consumer not only with the required washing performance but also with a visually and sensorially "typical and unmistakable" product. Suitable perfume oils or fragrances include individual fragrance compounds, for example synthetic products of the ester, ether, aldehyde, ketone, alcohol and hydrocarbon type. Fragrance compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol and the hydrocarbons include, above all, the terpenes, such as limonene and pinene. However, mixtures of various fragrances which together produce an attractive fragrance note are preferably used. Perfume oils such as these may also contain natural fragrance mixtures obtainable from vegetable sources, for example pine, citrus, jasmine, patchouli, rose or ylang-ylang oil. Also suitable are clary oil, camomile oil, nettle oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The detergent compositions according to the invention normally contain less than 0.01% by weight of dyes whereas perfumes/fragrances can make up as much as 2% by weight of the formulation as a whole.

The fragrances may be directly incorporated in the detergents according to the invention, although it can also be of advantage to apply the fragrances to supports which strengthen the adherence of the perfume to the washing and which provide the textiles with a long-lasting fragrance through a slower release of the perfume. Suitable support materials are, for example, cyclodextrins, the cyclodextrin/perfume complexes optionally being coated with other auxiliaries.

In order to improve their aesthetic impression, the detergents according to the invention may be colored with suitable dyes. Preferred dyes, which are not difficult for the expert to choose, have high stability in storage, are not affected by the other ingredients of the detergents or by light and do not have any pronounced substantivity for textile fibers so as not to color them.

EXAMPLES

Portion bags were made from a 25 μm thick polyvinyl alcohol film (manufacturer: Aquafilm Ltd.) which is made up of various Mowiol® types (products of HOECHST AG). The portion bags were then each filled with 40 g of a detergent composition. The bags were heat-sealed by permanently heated sealing rails. For Comparison Example V, the detergent composition was produced by a granulation process. In Example E according to the invention, the identical detergent composition was produced by extrusion and had a distinctly narrower particle size distribution. The sieve analyses of the two compositions are shown in the following Table:

| Sieve analysis | E | V |
|---|---|---|
| >16 mm | 2.5 | 27.0 |
| >0.8 mm | 93.2 | 26.0 |
| >0.4 mm | 4.2 | 30.0 |
| <0.4 mm | 0.1 | 17.0 |

In the case of the portioned detergent compositions E according to the invention, impervious and optically isotropic seams with no residues of product were obtained. In the case of Comparison Example V, the seams were partly permeable and optically anisotropic.

What is claimed is:

1. A portioned detergent composition comprising a sealed water-soluble film bag containing a particulate detergent composition comprising an anionic surfactant and a builder, wherein the particle size of at least 70 percent by weight of said detergent composition is greater than 800 micrometers to 5 mm.

2. The portioned detergent composition of claim 1 wherein the particle size of at least 70 percent by weight of the detergent composition is greater than 900 micrometers to 5 mm.

3. The portioned detergent composition of claim 2 wherein the particle size of at least 70 percent by weight of the detergent composition is greater than 1,000 micrometers to 5 mm.

4. The portioned detergent composition of claim 3 wherein the particle size of at least 70 percent by weight of the detergent composition is greater than 1,200 micrometers to 5 mm.

5. The portioned detergent composition of claim 1 wherein the particle size of at least 80 percent by weight of the detergent composition is greater than 800 micrometers to 5 mm.

6. The portioned detergent composition of claim 5 wherein the particle size of at least 85 percent by weight of the detergent composition is greater than 800 micrometers to 5 mm.

7. The portioned detergent composition of claim 6 wherein the particle size of at least 90 percent by weight of the detergent composition is greater than 800 micrometers to 5 mm.

8. The portioned detergent composition of claim 7 wherein the particle size of at least 95 percent by weight of the detergent composition is greater than 800 micrometers to 5 mm.

9. The portioned detergent composition of claim 7 wherein the particle size of at least 90 percent by weight of the detergent composition is greater than 1000 micrometers to 5 mm.

10. The portioned detergent composition of claim 1 wherein the water-soluble film bag comprises a polymer selected from the group consisting of acetalized polyvinyl alcohol, polyvinyl pyrrolidone, polyethylene oxide, gelatin, starch, starch derivatives, cellulose, methyl cellulose, and cellulose derivatives.

11. The portioned detergent composition of claim 1 wherein the water-soluble film bag comprises a polymer having a molecular weight in the range of from 5,000 to 500,000 dalton.

12. The portioned detergent composition of claim 11 wherein the water-soluble film bag comprises a polymer having a molecular weight in the range of from 7,500 to 250,000 dalton.

13. The portioned detergent composition of claim 12 wherein the water-soluble film bag comprises a polymer having a molecular weight in the range of from 10,000 to 100,000 dalton.

14. The portioned detergent composition of claim 1 wherein the water-soluble film bag has a thickness of 1 to 150 micrometers.

15. The portioned detergent composition of claim 14 wherein the water-soluble film bag has a thickness of 2 to 100 micrometers.

16. The portioned detergent composition of claim 15 wherein the water-soluble film bag has a thickness of 10 to 50 micrometers.

17. The portioned detergent composition of claim 1 wherein the detergent composition is formed by a granulation or press agglomeration process.

18. A process for producing a portioned detergent composition comprising:

(a) blending an anionic surfactant, a builder and at least one ingredient selected from the group consisting of nonionic surfactants, zwitterionic surfactants, cationic surfactants, bleaching agents, bleach activators, enzymes, foam inhibitors, dyes, fragrances, binders and disintegration aids to form a detergent composition;

(b) shaping the detergent composition into particles, wherein the particle size of at least 70 percent by weight of said detergent composition is greater than 800 micrometers to 5 mm; and (c) sealing the shaped detergent particles in a water-soluble film bag.

19. The process of claim 18 comprising shaping the detergent composition into particles by granulation or press agglomeration.

* * * * *